US009240300B2

(12) United States Patent
Xu et al.

(10) Patent No.: US 9,240,300 B2
(45) Date of Patent: Jan. 19, 2016

(54) DEVICE COMPRISING A THERMAL FUSE AND A RESISTOR

(75) Inventors: Zhonghou Xu, Xiamen (CN); Yousheng Xu, Xiamen (CN); Xuanhui Zhu, Xiamen (CN)

(73) Assignee: XIAMEN SET ELECTRONICS CO., LTD, Xiamen (CN)

( * ) Notice: Subject to any disclaimer, the term of this patent is extended or adjusted under 35 U.S.C. 154(b) by 207 days.

(21) Appl. No.: 13/977,672

(22) PCT Filed: Dec. 28, 2011

(86) PCT No.: PCT/CN2011/084826

§ 371 (c)(1),
(2), (4) Date: Jun. 28, 2013

(87) PCT Pub. No.: WO2012/089124

PCT Pub. Date: Jul. 5, 2012

(65) Prior Publication Data

US 2013/0293343 A1 Nov. 7, 2013

(30) Foreign Application Priority Data

Dec. 31, 2010 (CN) ..... 2010 2 0697438

(51) Int. Cl.

| | |
|---|---|
| ***H01C 13/00*** | (2006.01) |
| ***H01H 85/00*** | (2006.01) |
| ***H01C 1/14*** | (2006.01) |
| ***H01C 3/20*** | (2006.01) |
| ***H01C 1/08*** | (2006.01) |

(Continued)

(52) U.S. Cl.

CPC ..... *H01H 85/0052* (2013.01); *H01C 1/08* (2013.01); *H01C 1/14* (2013.01); *H01C 3/20* (2013.01); *H01C 13/00* (2013.01); *H01H 37/761* (2013.01); *H05B 1/0205* (2013.01); *H01H 85/0241* (2013.01); *H01H 85/165* (2013.01)

(58) Field of Classification Search

CPC ..... H01H 85/0052

See application file for complete search history.

(56) References Cited

U.S. PATENT DOCUMENTS 3,735,312 A * 5/1973 Nagel ..... 337/164
3,836,883 A * 9/1974 Takayasu et al. ..... 337/163

(Continued)

FOREIGN PATENT DOCUMENTS

CN 2233617 Y 8/1996
CN 101859665 A 10/2010

(Continued)

*Primary Examiner* — James Harvey
(74) *Attorney, Agent, or Firm* — Gokalp Bayramoglu

(57) ABSTRACT

The present invention discloses a device comprising a thermal fuse and a resistor, the solid ceramic base of the wirewound resistor is changed to be hollow, forming a ceramic tube; the thermal fuse is placed in the solid ceramic base, the ceramic tube provides housing for the thermal fuse; a lead wire of the thermal fuse passes through an end cap of an end of the wirewound resistor, the other end of the thermal fuse extends out of the end cap of the other end of the wirewound resistor, the end cap of the wirewound resistor extends outwardly with a lead wire, then an epoxy resin is used to encapsulate the device. The present invention can be used as a basic unit and directly installed in an existing high-frequency charger; it is capable of replacing the existing simple wirewound resistor or the wirewound resistor with an external contact type thermal fuse, and realizing triple functions of general impedance, over-current fuse protection, and over-temperature protection in case of overload.

9 Claims, 4 Drawing Sheets

(51) Int. Cl.

| | |
|---|---|
| ***H01H 37/76*** | (2006.01) |
| ***H05B 1/02*** | (2006.01) |
| *H01H 85/02* | (2006.01) |
| *H01H 85/165* | (2006.01) |

(56) References Cited

U.S. PATENT DOCUMENTS

| | | | | | |
|---|---|---|---|---|---|
| 3,836,884 | A * | 9/1974 | Oliver | 337/163 |
| 4,006,443 | A * | 2/1977 | Kouchich et al. | 338/215 |
| 4,527,143 | A * | 7/1985 | Thienel | 337/242 |
| 4,593,262 | A * | 6/1986 | Krueger | 337/163 |
| 5,418,516 | A * | 5/1995 | Oh | 338/21 |
| 2004/0100352 | A1 * | 5/2004 | Tanaka | 337/159 |
| 2005/0128044 | A1 * | 6/2005 | Iwamoto et al. | 337/159 |
| 2005/0248433 | A1 * | 11/2005 | Kim et al. | 338/24 |
| 2011/0188165 | A1 * | 8/2011 | El Filali et al. | 361/93.9 |
| 2012/0038450 | A1 * | 2/2012 | Jung et al. | 337/184 |
| 2013/0293343 | A1 * | 11/2013 | Xu et al. | 338/269 |

FOREIGN PATENT DOCUMENTS

| | | | |
|---|---|---|---|
| CN | 201655721 | U | 11/2010 |
| JP | 08-250301 | A | 9/1996 |
| JP | 2004241665 | A | 8/2004 |

* cited by examiner

DEVICE COMPRISING A THERMAL FUSE AND A RESISTOR

FIELD OF THE INVENTION

The present invention relates to a resistor against over-current and over-temperature. The device is a quick response structure with a resistor and a thermal fuse integration, the size is similar to a same power wirewound resistor, carbon-film resistor or a metal-film resistor. The device is used as over-heating protection resistor of in the power supply such as the household electric appliance, IT communication equipment or lighting equipment, it can also be used as a heating element with over-heating protection.

The present invention further relates to a thermal fuse with self-heating function, it can be applied in blockage protection of the motor of the power tool or electrical fan; when the motor is blocked, the current makes the thermal fuse cut off by self-heating faster than the increasing rate of the temperature of the coil of the motor, thus assuring that the motor will not damage under over-heating before the cut-off of the thermal fuse, it can be effectively used to against over-heating of the motor.

BACKGROUND OF THE INVENTION

With wide application of micro-electrical equipment, especially the mobile communication equipment, charging device for battery becomes the necessity of the mobile equipment. A high-frequency circuit is usually used to design and build a charger for conveniently carrying and the self-adaptation the AC100V~240V mains voltage, therefore the safety performance of the charger appears particularly important. A current-limiting resistor against over-current and over-temperature is the key component for the safety of the high-frequency circuit. The present invention provides to meet the demand of safety requirements, further achieving reliability and quick response.

Although the wirewound resistor also has an over-current fuse function, the resistor wire is applied with a high melting point alloy and the alloy wire of the wirewound resistor will melt to realize fuse function only if subjected to a current which is over 20 times of the rated current. However, in actual application, when the load is abnormal, the current of the wirewound resistor is often unable to reach the current level which the wirewound resistor material can melt, therefore cause the fuse function of the wirewound resistor can't be realized, while the temperature of the wirewound resistor reaches 300~500° C.

This is a serious problem and dangerous condition for the charger. Under these conditions, people use an external contact type thermal fuse connected in series and placed inside a ceramic box, and when the thermal fuse senses that the temperature of the wirewound resistor reaches the rated temperature of the thermal fuse, the thermal fuse will melt to cut off the circuit. However, thermal fuse occupies additional area in the PCB and it needs 4 bonding pads under such operation.

Moreover, according to safety consideration, the micro-heating elements used in daily life, such as aromatherapy diffuser or mosquito repellant electric liquid vaporizer, are applied with a thermal fuse against over-heating. Existing assembly method is to connect a resistor and a thermal fuse in series then assemble the unit inside a ceramic box, and the box is filled with solidifiable insulation material. This makes the size of the product large, therefore the heat may be lost and the energy may be wasted.

In addition, the current of the motor of a power tool or an electrical fan is six times the normal working current when they are blocked, under which condition the motor heats quickly. It needs a thermal fuse to cut off the current to prevent a fire because of over-heating condition. But not expected to decrease the operation temperature of the thermal fuse to increase the agility. However, mild overload or voltage pulsation happens when the motor works, under these mild conditions, the thermal fuse is expected not to be cut off. So there is an issue with setting up the temperature of the thermal fuse.

A component comprising a thermal fuse and a resistor of new, small size, an integrated structure and fast installation is provided, the structure solves above three problems.

SUMMARY OF THE INVENTION

The present invention discloses a resistor used to the input of a high-frequency charger, and it adopts an alloy wire as the resistor, which not only has a resistor function but also has an over-current fuse protection function. A thermal fuse is disposed inside the base of the wirewound resistor and connected to the resistor in series in the circuit. When the wirewound resistor heats to the rated temperature, the thermal fuse melts and provides an over-heating protection function.

The present invention relates to a wirewound resistor with a built-in thermal fuse, in which the solid ceramic base of the wirewound resistor is changed to be hollow, a thermal fuse is placed in the ceramic base, the ceramic tube provides housing for the thermal fuse; a lead wire of the thermal fuse passes through an end cap of an end of the wirewound resistor, connecting tightly thereto and forming a serial connection structure. The other lead wire of the thermal fuse extends out of the end cap of the other end of the wirewound resistor, the end cap of the wirewound resistor with an opening extends outwardly with a lead wire, and then the device is encapsulated in an epoxy resin.

The present invention of a wirewound resistor with a built-in thermal fuse can be used as a basic unit to be assembled directly to the existing high-frequency charger, the wirewound resistor with a built-in thermal fuse can take the place of the existing simple wirewound resistor or the wirewound resistor with an external contact type thermal fuse, realizing triple functions of general impedance, over-current fuse protection, and over-temperature protection in case of overloaded.

The resistor value of the wirewound resistor with above structure is set at 0.5Ω, the temperature of the coupling thermal fuse is 150° C. is used in a motor of a power tool. Take a thermal fuse with rated current 2 A for example, when the normal working current is 0.5 A, the temperature of the thermal fuse rises about 5° C. due to the resistor. But when the motor is blocked, the current reaches 3 A, the heat of the resistor makes the temperature of the thermal fuse rise rapidly, and therefore the thermal fuse is cut off before the motor coil is damaged.

According to above structure, replacing the wirewound resistor with a carbon-film resistor or a metal-film resistor, the resistor value is increased greatly. This structure can be used in micro-heater, it could be fixed into a ceramic tube to serve as a heater of an aromatherapy diffuser or mosquito repellant electric liquid vaporizer, and the heater can be placed in a diffusing stick of perfume or other liquid, so that the thermal power of the heater can be absorbed by the perfume or other liquid. Existing technology is applied with a ceramic structure, a side of which is disposed with a hole to fix the diffusing stick while the other side is disposed with a cavity for assembling a heating resistor and a thermal fuse and sealed with solidifiable insulation material. Comparing above two manners, basic on same diffusion rate of the perfume, the power of the existing technology of the heater is about 2.2 W, and the power of the heater of the present invention is about 1 W, so that the heating temperature of the resistor is decreased accordingly, the stability of the resistor value of the resistor is improved greatly and the diffusion rate of the perfume is more stable, and the influence under the environmental temperature is decreased. If the power of each aromatherapy diffuser decreases 1 W, totally 9 kW power can be saved every year. If there are 50 millions heaters such as aromatherapy diffuser or mosquito repellant electric liquid vaporizer working in the world, 45000 kW power can be saved totally, therefore carbon emission can be decreased greatly.

DETAILED DESCRIPTION OF THE EMBODIMENTS

The First Embodiment

Figure 1:
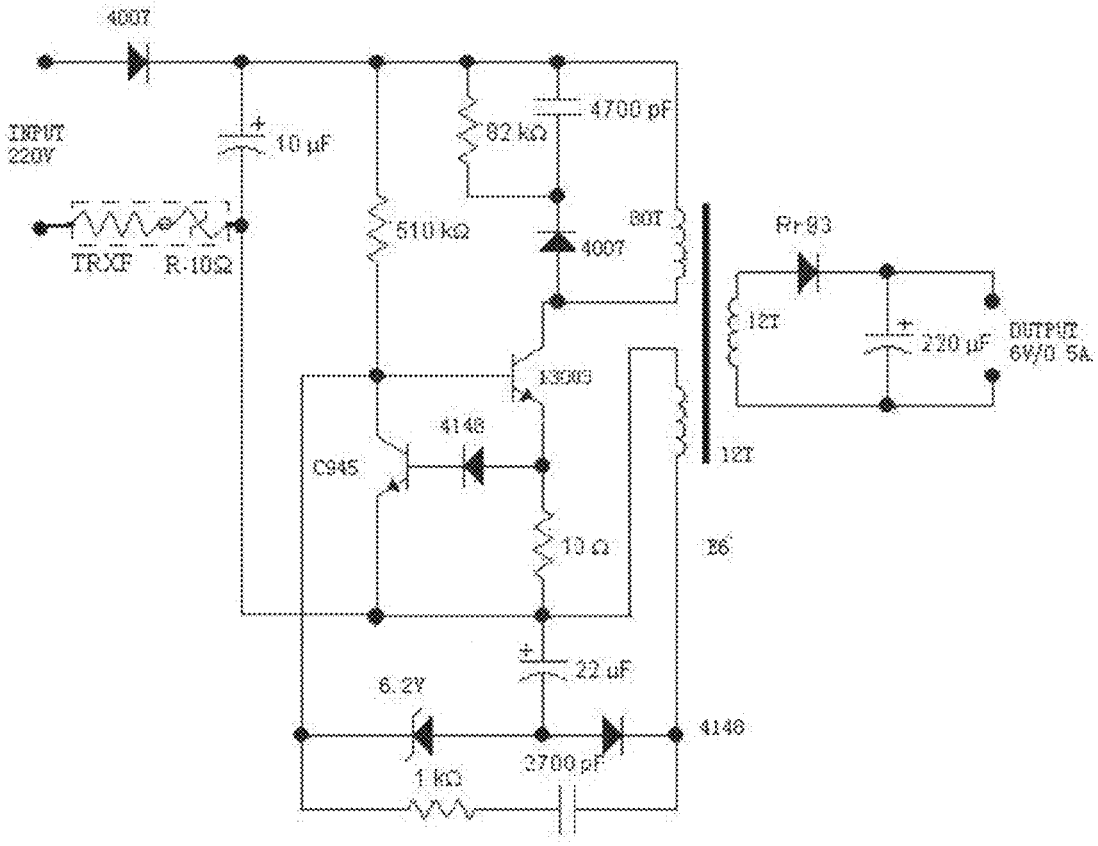
FIG. 1 illustrates the circuit diagram of the first embodiment.
Figure 2A:
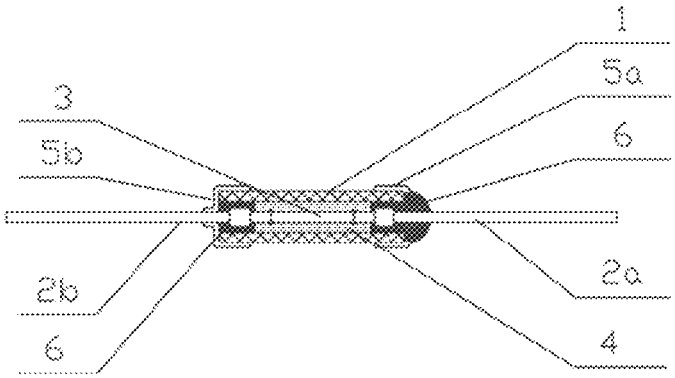
FIG. 2A illustrates a sectional view of the first embodiment with a built-in thermal fuse.
Figure 3A:
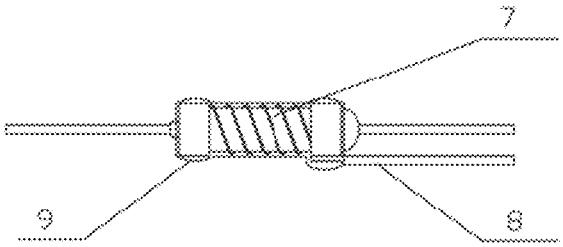
FIG. 3A illustrates a schematic view of the configuration of the wirewound resistor of the first embodiment.

The first embodiment will be further described with the FIG. 1, FIG. 2A and FIG. 3A. Therein, the object of the embodiment is to describe the preferred embodiment of the present invention, but not to limit the invention to a specific embodiment.

FIG. 1 is the circuit of a switched power supply charger of a mobile phone or an MP3, and the circuit is applied with the device comprising a thermal fuse and a resistor of the present invention; in FIG. 2A, lead wires 2*b*, 2*a* of the thermal fuse is welded with alloy wire 3 with a low-melting point. Fluxing promoting agent 4 is disposed around alloy wire 3 to improve the alloy wire to contract oppositely to cut off when melting; the thermal fuse, fluxing promoting agent 4 and alloy wire 3 form an integration under normal temperature and placed inside the ceramic tube, then two ends of the ceramic tube are sealed with epoxy resin 6 as an entire thermal fuse.

As illustrated in FIG. 2A, when above thermal fuse is formed, putting metal caps 5*a*, 5*b* to lock to the two ends of ceramic tube 1 of the thermal fuse, forming a tight integration.

The centre of metal cap 5*b* extends outwardly to form a liplike edge which is connected to lead wire 2*b* of the thermal fuse; after metal cap 5*b* is welded to the alloy wire of the wirewound resistor, the thermal fuse and the wirewound resistor are connected in series.

Metal cap 5*a* has a center hole large enough for the passing through of lead wire 2*a* of the thermal fuse, and a clearance is formed between the center hole and lead wire 2*a*, the creepage distance between lead wire 2*a* and metal cap 5*a* is increased to a safe distance after the clearance is solidified with epoxy resin 6.

After two ends of ceramic tube 1 of the thermal fuse are sleeved with metal caps 5*a*, 5*b*, basic body of the wirewound resistor is shaped. Impedance alloy wire 7 is wound on the basic body; two ends of impedance alloy wire 7 are welded to metal caps 5*a*, 5*b*. Then lead wire 8 is further welded to metal cap 5*a* as the output of the wirewound resistor. The device is encapsulated with epoxy resin 9 finally. In this way, a wirewound resistor with a built-in thermal fuse is achieved, as illustrated in FIG. 3A.

Figure 4A:
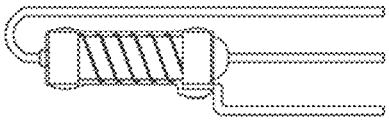
FIG. 4A illustrates a device of the first embodiment in actual application.
Figure 4B:
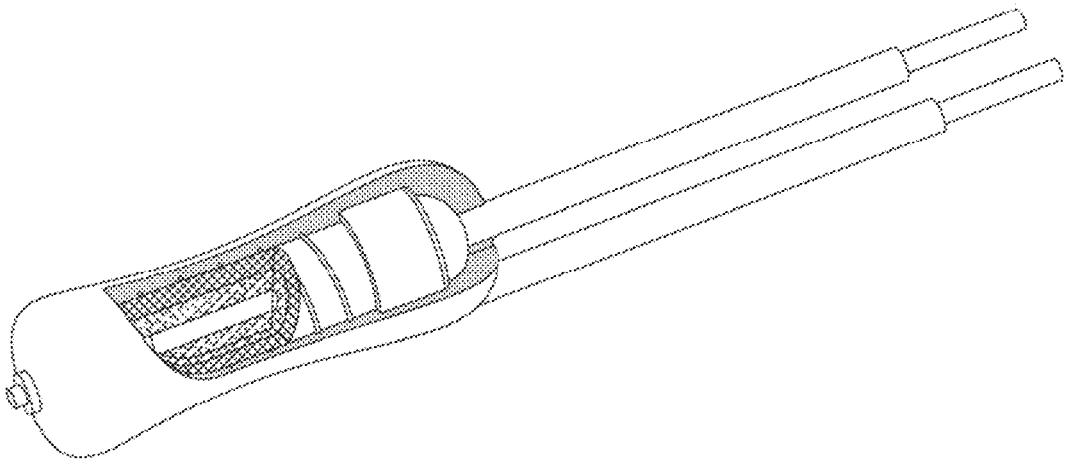
FIG. 4B illustrates a schematic view of the configuration of a device of the first embodiment without the lead wire in the common ports of the wirewound resistor and the thermal fuse.
Figure 5:
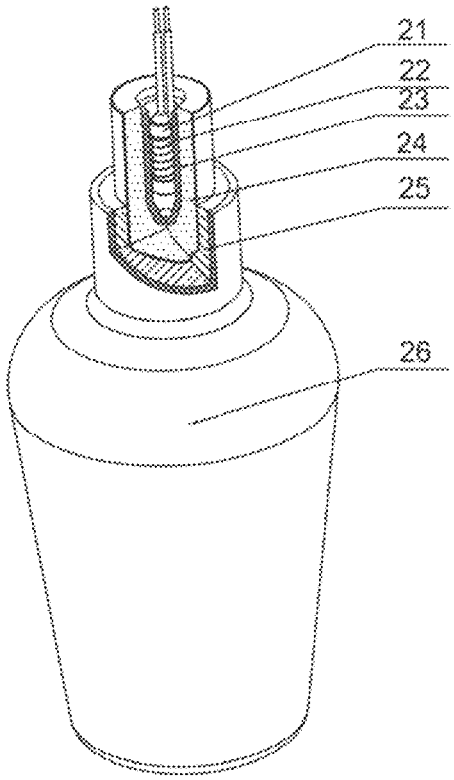
FIG. 5 illustrates a schematic view of a device of third embodiment applied in an aromatherapy diffuser.

FIG. 4 and FIG. 5 are the actual assemblies of devices embodying the present invention. FIG. 4B is a circuit structure that the thermal fuse and the wirewound resistor are connected in series with an end as an input and the other end as an output. FIG. 1 is the circuit of the present invention applied in a high-frequency charger, in which the wirewound resistor is in over-temperature protection mode.

The Second Embodiment

Figure 2B:
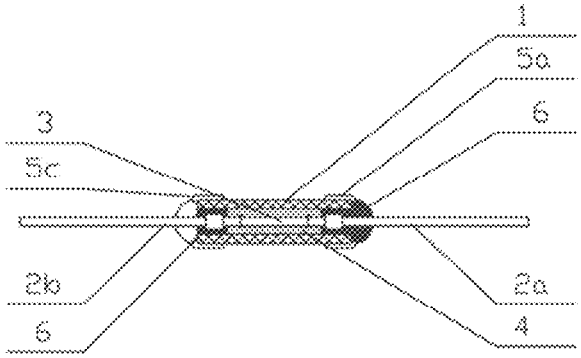
FIG. 2B illustrates a sectional view of the second embodiment with a built-in thermal fuse.
Figure 3B:
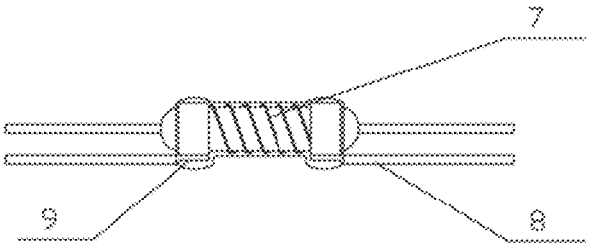
FIG. 3B illustrates a schematic view of the configuration of the wirewound resistor of the second embodiment.

As illustrated in FIG. 2B and FIG. 3B, different from the first embodiment, the thermal fuse and the wirewound resistor are disposed in a parallel circuit; the wirewound resistor is wound on the ceramic housing of the thermal fuse. The lead wires of the metal caps (5*a*, 5*c*) of two ends of the wirewound resistor are not connected to the lead wires of the thermal fuse.

The Third Embodiment

The table below shows the protection result data of the wirewound resistor with a thermal fuse in the first embodiment. In a high-frequency power supply, it often applies a 10Ω/2 W wirewound resistor and a 221° C. thermal fuse against over-heating. The comparison of cut-off speed between the external contact type and the built-in type (the first embodiment) is as below. If single wirewound resistor is not added, high surface temperature for a long time is a potential danger under the currents in the table.

TABLE 1

| Number | Test Current A | Surface Temperature of the External Contact Type Resistor ° C. | Cut-off Time of the External Contact Type Thermal Fuse S | Surface Temperature of the Built-in Type Resistor ° C. | Cut-off Time of the Built-in Type Thermal Fuse S |
|---|---|---|---|---|---|
| 1 | 0.5 | 142 | Not Cut-off in 600 s | 145 | Not Cut-off in 600 s |

TABLE 1-continued

| Number | Test Current A | Surface Temperature of the External Contact Type Resistor ° C. | Cut-off Time of the External Contact Type Thermal Fuse S | Surface Temperature of the Built-in Type Resistor ° C. | Cut-off Time of the Built-in Type Thermal Fuse S |
|---|---|---|---|---|---|
| 2 | 0.5 | 139 | Not Cut-off in 601 s | 142 | Not Cut-off in 601 s |
| 3 | 0.5 | 146 | Not Cut-off in 602 s | 148 | Not Cut-off in 602 s |
| 4 | 0.5 | 143 | Not Cut-off in 603 s | 145 | Not Cut-off in 603 s |
| 5 | 0.6 | 175 | 36 s | 176 | 18 s |
| 6 | 0.6 | 174 | 37 s | 177 | 19 s |
| 7 | 0.6 | 178 | 36 s | 176 | 18 s |
| 8 | 0.6 | 176 | 39 s | 178 | 18 s |
| 9 | 0.7 | 189 | 26 s | 190 | 8 s |
| 10 | 0.7 | 187 | 27 s | 192 | 7 s |
| 11 | 0.7 | 190 | 23 s | 193 | 8 s |
| 12 | 0.7 | 188 | 24 s | 189 | 7 s |
| 13 | 0.8 | 211 | 14 s | 215 | 1.2 s |
| 14 | 0.8 | 209 | 16 s | 212 | 1.0 s |
| 15 | 1 | 234 | 8 s | 238 | 0.2 s |
| 16 | 1 | 232 | 9 s | 242 | 0.2 s |

The Fourth Embodiment

The structure of the fourth embodiment is the same as that of the first embodiment, but with different resistor value and temperature from the first embodiment, the heating of the wirewound resistor accelerates the cut-off of the thermal fuse; it is mainly used in the motor against over-temperature. The resistor value of the wirewound resistor with above structure is set at 0.5Ω, the temperature of the coupling thermal fuse is 150° C. used in a motor of a power tool, take a thermal fuse with rated current 2 A for example, when the normal working current is 0.5 A, the temperature that the thermal fuse sensed rises about 5° C. due to the resistor. But when the motor is blocked, the current reaches 3 A, the heat of the resistor makes the temperature of the thermal fuse rising rapidly, and therefore the thermal fuse is cut off before the motor coil is damaged, preventing the motor coil from burning and improving the recycling value. It can be further described with the data below:

TABLE 2

| Number | Fusing Current A | Temperature of the Simulation Coil ° C. | Surface Temperature of the Wirewound Resistor ° C. | Cut-off Time of the TCO | Withstand Voltage |
|---|---|---|---|---|---|
| 1 | 0.5 | 62.8 | 74.9 | Not Cut-off in a Long Time | |
| 2 | 0.5 | 63.1 | 75.4 | Not Cut-off in a Long Time | |
| 3 | 0.5 | 62.9 | 75.8 | Not Cut-off in a Long Time | |
| 4 | 1 | 63.6 | 90.2 | Not Cut-off in a Long Time | |
| 5 | 1 | 63.8 | 90.8 | Not Cut-off in a Long Time | |
| 6 | 1 | 63.9 | 91.4 | Not Cut-off in a Long Time | |
| 7 | 1.5 | 64.5 | 107.4 | Not Cut-off in a Long Time | Not Breakdown in 500 V |
| 8 | 1.5 | 64.6 | 106.9 | Not Cut-off in a Long Time | Not Breakdown in 500 V |
| 9 | 1.5 | 64.7 | 107.8 | Not Cut-off in a Long Time | Not Breakdown in 500 V |
| 10 | 2 | 65.4 | 132.5 | 58 | Not Breakdown in 500 V |
| 11 | 2 | 65.5 | 132.1 | 52 | Not Breakdown in 500 V |
| 12 | 2.5 | 66.7 | 162.7 | 7 | Not Breakdown in 500 V |
| 13 | 2.5 | 66.4 | 160.2 | 6 | Not Breakdown in 500 V |

TABLE 2-continued

| Number | Fusing Current A | Temperature of the Simulation Coil ° C. | Surface Temperature of the Wirewound Resistor ° C. | Cut-off Time of the TCO | Withstand Voltage |
|---|---|---|---|---|---|
| 14 | 3 | 69.4 | 167.5 | 3 | Not Breakdown in 500 V |

The Fifth Embodiment

The structure of the fifth embodiment is the same as that of the first embodiment, as illustrated in FIG. 4B, replacing the wirewound resistor with a carbon-film resistor or a metal-film resistor 22, the resistor value is increased to thousands of ohms, therefore this structure can be used as micro-heater 21 (as illustrated in FIG. 5); micro-heater 21 with a built-in thermal fuse is made into an aromatherapy diffuser which comprising micro-heater 21, housing 23, diffusing stick 24, sealing ring 25, and perfume bottle 26. Putting housing 23 with built-in micro-heater 21 into diffusing stick 24, then inserting diffusing stick 24 into perfume bottle 26 through sealing ring 25; thereby the aromatherapy diffuser is achieved.

According to above data comparison, under equal temperature of the diffusing stick, the power consumption of this embodiment is a saving of 50% power to existing technology.

The Sixth Embodiment

Figure 6:
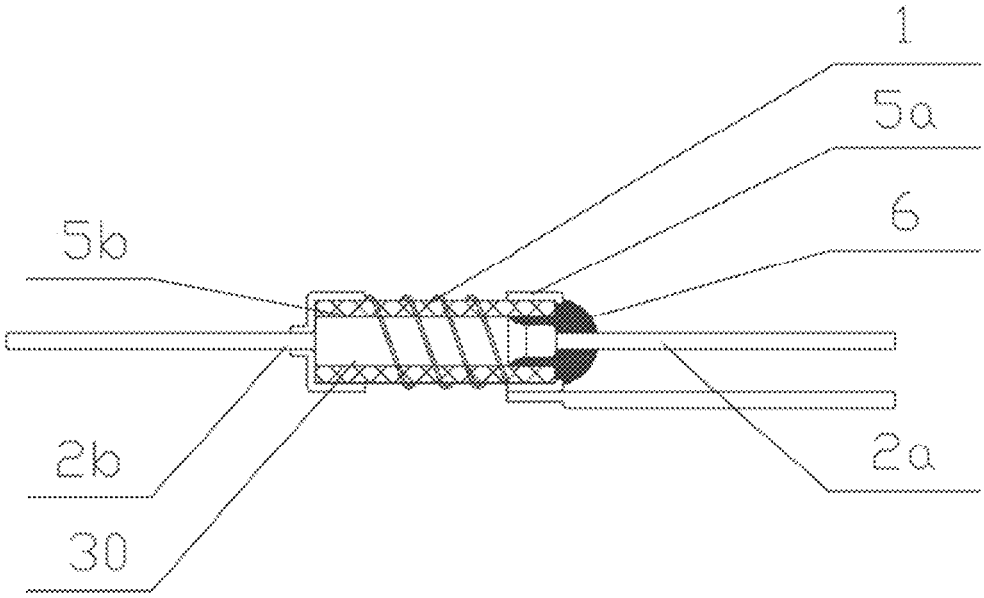
FIG. 6 illustrates the structure of fourth embodiment of a resistor comprising a built-in thermal fuse with organic matter for sensing temperature.
Figure 7:
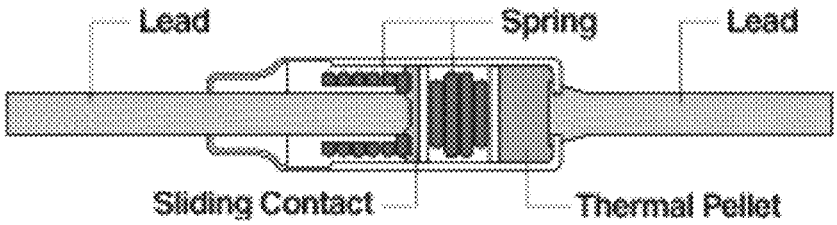
FIG. 7 illustrates the principle diagram of the fourth embodiment of a resistor comprising a built-in thermal fuse with organic matter for sensing temperature.

As illustrated in FIG. 6, thermal fuse 30 with organic matter for sensing temperature is disposed inside ceramic tube 1 (the principle structure is illustrated in FIG. 7), two ends of ceramic tube 1 are tightly locked with metal caps 5*a*, 5*b*, thus forming a tight integration. The centre of metal cap 5*b* extends outwardly to form a liplike edge which is tightly connected to lead wire 2*b* of thermal fuse 30; after metal cap 5*b* is welded with the alloy wire of the wirewound resistor, the thermal fuse and the wirewound resistor are connected in

TABLE 3

Test Report of the Comparison of the Heating of the Resistor

| Assembly Type of the Heating Resistor | Test Voltage | Current | Real Power | Resistor ValueΩ | Surface Temperature ° C. | Temperature of the Diffusion Staff ° C. |
|---|---|---|---|---|---|---|
| a Resistor with a 130° C. External Contact Thermal Fuse is Encapsulated by a Ceramic Housing | 120 VAC | 18.52 mA | 2.2 W | 6.5K | 97.5 | 89.6 |
| a Resistor with a 130° C. External Contact Thermal Fuse is Encapsulated by a Ceramic Housing | 120 VAC | 18.51 mA | 2.2 W | 6.5K | 94.3 | 88.2 |
| a Resistor with a 130° C. External Contact Thermal Fuse is Encapsulated by a Ceramic Housing | 120 VAC | 18.55 mA | 2.2 W | 6.5K | 95.6 | 87.9 |
| a Resistor with a 130° C. External Contact Thermal Fuse is Encapsulated by a Ceramic Housing | 120 VAC | 18.52 mA | 2.2 W | 6.5K | 96.8 | 86.5 |
| a Resistor with a 130° C. External Contact Thermal Fuse is Encapsulated by a Ceramic Housing | 120 VAC | 18.53 mA | 2.2 W | 6.5K | 95.8 | 87.9 |
| a Resistor with a Built-in Thermal Fuse | 120 VAC | 10.4 mA | 1.25 W | 11.5K | 92 | 92 |
| a Resistor with a Built-in Thermal Fuse | 120 VAC | 10.4 mA | 1.25 W | 11.5K | 90.8 | 90.8 |
| a Resistor with a Built-in Thermal Fuse | 120 VAC | 10.4 mA | 1.25 W | 11.5K | 93.2 | 93.2 |
| a Resistor with a Built-in Thermal Fuse | 120 VAC | 10.4 mA | 1.25 W | 11.5K | 92.7 | 92.7 |
| a Resistor with a Built-in Thermal Fuse | 120 VAC | 10.4 mA | 1.25 W | 11.5K | 91.8 | 91.8 |

series. Metal cap 5*a* has a center hole large enough for the passing through of lead wire 2*a* of thermal fuse 30, and a clearance is formed between the hole and lead wire 2*a*, the creepage distance between lead wire 2*a* and metal cap 5*a* is increased to a safe distance after the clearance is solidified with epoxy resin 6. If the shape of metal cap 5*b* is like the metal cap 5*a*, and lead wire 2*b* of thermal fuse 30 is capable of passing through the centre of metal cap 5*b*, and a clearance is formed between the hole and lead wire 2*b*, therefore the creepage distance of lead wire 2*b* and metal cap 5*b* is increased to a safe distance after the clearance is solidified with epoxy resin 6. At the time, the resistor and the thermal fuse have no electrical connections but quick thermal transfer.

After two ends of ceramic tube 1 of the thermal fuse are sleeved with the metal caps 5*a*, 5*b* tightly, basic body of the wirewound resistor is shaped accordingly. Impedance alloy wire 7 is wound on the basic body; two ends of impedance alloy wire 7 are welded to metal cap 5*a*, 5*b*. Then lead wire 8 is further welded to metal cap 5*a* as the output of the wirewound resistor. The device is encapsulated with epoxy resin 9 finally. In this way, a wirewound resistor with a built-in thermal fuse is achieved. The wirewound resistor on the external surface of the ceramic tube 1 can be changed into a carbon-film resistor, a metal-film resistor or a thick film resistor, thus forming a resistor against over-temperature with different powers.

What is claimed is:

1. A device comprising:

a thermal fuse;

a wire wound resistor;

a first lead wire of the thermal fuse;

a second lead wire of the thermal fuse;

a hollow ceramic tube;

a low melting point alloy wire welded between the first lead wire of the thermal fuse and the second lead wire of the thermal fuse;

a fluxing promoting agent;

an epoxy resin used to seal two ends of the hollow ceramic tube;

a first metal cap and a second metal cap of the wire wound resistor to lock the two ends of the thermal fuse to form a tight integration and electrically connect with two ends of the wire wound resistor;

wherein the hollow ceramic tube provides housing for the thermal fuse;

wherein the wire wound resistor is wounded on the outer surface of the hollow ceramic tube;

wherein the first lead wire of the thermal fuse and the second lead wire of the thermal fuse respectively pass through the first metal cap and the second metal cap; and wherein the device is encapsulated in the epoxy resin to be insulated, or applied with silicone or inorganic material as an insulation layer.

2. The device of claim 1, wherein the first led wire of the thermal fuse electrically connects with the first metal cap, the wire wound resistor is then in serial connection with the thermal fuse.

3. The device of claim 2, wherein the fluxing promoting agent is disposed around the low melting point alloy wire to improve the alloy wire to contract oppositely and cut off when melting; wherein the thermal fuse, fluxing promoting agent and the low melting point alloy wire form an integration under normal temperature and placed inside the ceramic tube.

4. The device of claim 2, wherein the wire wound resistor with the thermal fuse, which is configured as a basic unit and disposed directly in a high-frequency charger.

5. The device of claim 2, wherein the resistor value of the wire wound resistor is coupled with the temperature value of the thermal fuse for accelerating the cut-off of the thermal fuse when the wire wound resistor is heated, and which is applied in over-temperature protection for motor.

6. The device of claim 2, wherein the wire wound resistor is a carbon-film resistor or a metal-film resistor to increase a resistor value to thousands of ohms, forming a heating resistor with over temperature protection.

7. The device of claim 1, wherein the first end cap and the second end cap are respectively disposed with an opening; wherein the first lead wire of the thermal fuse and the second lead wire of the thermal fuse respectively pass through the opening of the first end cap and the second end cap and extend outwardly from the opening;

wherein a first lead wire electronically connects with the first metal cap and a second lead wire electronically connects with the second metal cap are respectively extend outwardly from the openings, and then the device is encapsulated in the epoxy resin, forming a circuit that the thermal fuse and the resistor are parallel to each other for cutting off the thermal fuse by heating different circuits.

8. The device of claim 1, wherein the thermal fuse is made of organic material.

9. The device of claim 1, wherein two ends of the hollow ceramic tube open; wherein one end of the hollow ceramic tube opens and the other end of the hollow ceramic tube closes with a hole to let the first or second lead wire of the thermal fuse extend out.

* * * * *